US011833567B2

(12) United States Patent
Sakuramoto

(10) Patent No.: US 11,833,567 B2
(45) Date of Patent: Dec. 5, 2023

(54) DIE ADJUSTMENT SYSTEMS AND METHODS WITH DRAW IN SENSORS

(71) Applicant: GM GLOBAL TECHNOLOGY OPERATIONS LLC, Detroit, MI (US)

(72) Inventor: Carlos Yuji Sakuramoto, São Paulo (BR)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/729,538

(22) Filed: Apr. 26, 2022

(65) Prior Publication Data

US 2023/0339009 A1 Oct. 26, 2023

(51) Int. Cl.
*B21D 37/14* (2006.01)
*B21D 22/02* (2006.01)

(52) U.S. Cl.
CPC ..... *B21D 37/14* (2013.01); *B21D 22/02* (2013.01)

(58) Field of Classification Search
CPC ..... B21D 37/14; B21D 22/02; B21D 22/10
See application file for complete search history.

(56) References Cited

U.S. PATENT DOCUMENTS

| | | | | |
|---|---|---|---|---|
| 8,584,496 | B2 * | 11/2013 | Kuwayama | B21D 22/20 72/21.4 |
| 2005/0268685 | A1 * | 12/2005 | Bolt | B21D 24/14 72/351 |
| 2011/0192232 | A1 * | 8/2011 | Kuwayama | B21D 22/22 73/799 |
| 2019/0240941 | A1 * | 8/2019 | Schoellhammer | B21D 22/06 |

* cited by examiner

*Primary Examiner* — Teresa M Ekiert

(57) ABSTRACT

A die of a stamping press is described and includes: an upper portion including one or more first features; a lower portion including one or more second features that are complementary to the first features and apertures at locations, respectively, that extend through the lower portion; and optical sensors that are disposed within the apertures, respectively, of the lower portion and that are configured to measure directions of movement and distances of movement inward of outer edges of a substrate at the locations, respectively, during stamping of the substrate.

20 Claims, 6 Drawing Sheets

DIE ADJUSTMENT SYSTEMS AND METHODS WITH DRAW IN SENSORS

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to machine (stamping) presses and dies and more particularly to systems and methods for measuring material draw in during stamping.

Stamping presses can be used in many different industries. For example, a stamping press can be used in metalworking to shape or cut metal by deforming the metal with upper and lower parts of a die. The metal is positioned between the upper and lower parts of the die, which have female and male shaped portions. One or both of the upper and lower parts of the die are moved toward each other to deform the metal to the shape of the upper and lower parts of the die.

A bolster plate may be mounted on top of a press bed. A lower portion of the die may be attached to the bolster plate. An upper portion of the die is attached to a ram in the example of the upper portion of the die moving toward the lower portion, and the lower portion being fixed.

SUMMARY

In a feature, a stamping press system includes: a die including: an upper portion including one or more first features; a lower portion including one or more second features that are complementary to the first features and apertures at locations, respectively, at outer edges of a substrate to be stamped; and optical sensors that are disposed within the apertures, respectively, of the lower portion and that are configured to measure directions of movement and distances of movement inward of the outer edges of the substrate at the locations, respectively, during stamping; electric motors configured to at least one of: vertically lower the upper portion toward the lower portion; and vertically raise the lower portion toward the upper portion; and a motor control module configured to control application of power to the electric motors.

In further features, the motor control module is configured to control application of power to the electric motors during the at least one of the vertical lowering and the vertical raising based on at least one of the directions of movement.

In further features, the motor control module is configured to adjust power applied to at least one of the electric motors based on adjusting at least one of the distances toward to at least one other one of the distances.

In further features, the motor control module is configured to control application of power to the electric motors during the at least one of the vertical lowering and the vertical raising based on at least two of the distances of movement.

In further features, the optical sensors are fastened to the lower portion via one or more fasteners.

In further features, a draw in module is configured to generate a map based on at least one of the directions and the distances.

In further features, the motor control module is configured to control application of power to the electric motors during the at least one of the vertical lowering and the vertical raising based on the map.

In further features, the optical sensors each include a light transmitter and a light receiver.

In further features, a fault module is configured to selectively indicate the presence of a fault based on at least one of the directions and the distances.

In further features, the fault module is configured to, when the fault is present, indicate the presence of the fault via an output device that at least one of outputs sound and outputs light.

In further features, the motor control module is configured to disconnect the electric motors from power when fault is present.

In further features, the optical sensors are further configured to determine velocities of movement inward of the outer edges of the substrate at the locations, respectively, based on the distances of movement inward of the outer edges of the substrate at the locations, respectively.

In further features, the optical sensors are further configured to determine accelerations of movement inward of the outer edges of the substrate at the locations, respectively, based on the velocities of movement inward of the outer edges of the substrate at the locations, respectively.

In a feature, a die of a stamping press is described and includes: an upper portion including one or more first features; a lower portion including one or more second features that are complementary to the first features and apertures at locations, respectively, that extend through the lower portion; and optical sensors that are disposed within the apertures, respectively, of the lower portion and that are configured to measure directions of movement and distances of movement inward of outer edges of a substrate at the locations, respectively, during stamping of the substrate.

In further features, the optical sensors are fastened to the lower portion of the die via one or more fasteners.

In further features, the optical sensors each include a light transmitter and a light receiver.

In further features, the optical sensors are further configured to determine velocities of movement inward of the outer edges of the substrate at the locations, respectively, based on the distances of movement inward of the outer edges of the substrate at the locations, respectively.

In further features, the optical sensors are further configured to determine accelerations of movement inward of the outer edges of the substrate at the locations, respectively, based on the velocities of movement inward of the outer edges of the substrate at the locations, respectively.

In a feature, a stamping press system includes: a die including: an upper portion including one or more first features and apertures at locations, respectively, at outer edges of a substrate to be stamped; a lower portion including one or more second features that are complementary to the first features; and optical sensors that are disposed within the apertures, respectively, of the upper portion and that are configured to measure directions of movement and distances of movement inward of the outer edges of the substrate at the locations, respectively, during stamping; electric motors configured to at least one of: vertically lower the upper portion toward the lower portion; and vertically raise the lower portion toward the upper portion; and a motor control module configured to control application of power to the electric motors.

In further features, the motor control module is configured to control application of power to the electric motors during the at least one of the vertical lowering and the vertical raising based on at least one of the directions of movement.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Upper and lower portions of a die used in a stamping press have complementary shapes. For example, the lower portion of the die may have a male protrusion that extends upwardly toward the upper portion of the die. The upper portion of the die may have a female shape depression into which the male protrusion is to extend. The upper and lower portions of the die may be aligned via a costly and time consuming process by a diemaker to avoid the lower portion of the die from contacting the upper portion of the die at one or more locations.

The present application involves the lower portion (or the upper portion) of the die including draw in sensors configured to determine draw in distances and directions of a substrate (e.g., sheet metal) during stamping. An adjustment of the upper and/or lower portions of the die can be automatically triggered based on equalizing the measured draw in values across the substrate. This results in the stamped substrate having better characteristics, such as aesthetically and structurally.

Figure 1:
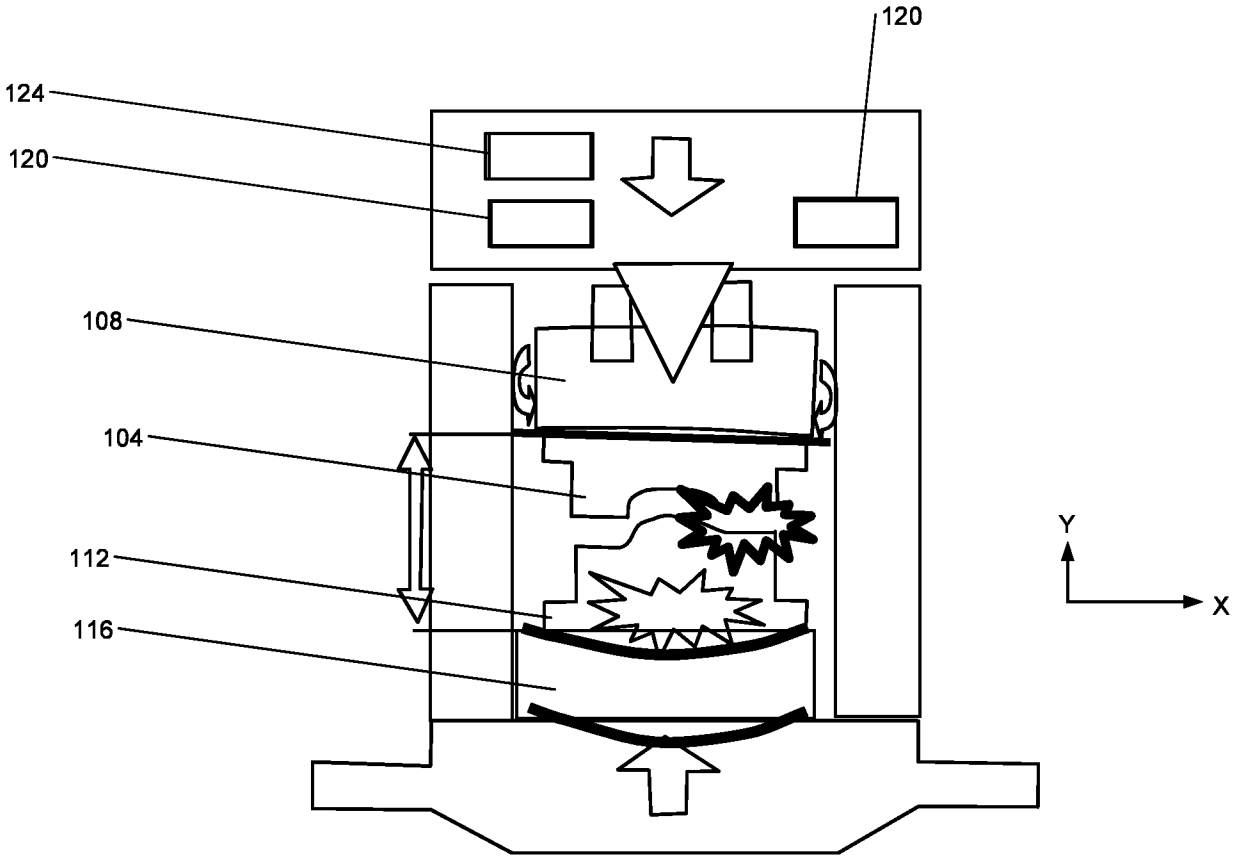
FIG. 1 is a perspective view of an example stamping press.

FIG. 1 is a side perspective view of an example stamping press. An upper portion 104 of a die is mounted to an upper portion 108 of the stamping press. A lower portion 112 of the die is mounted to a lower portion 116 of the stamping press. In this example, the upper portion 108 of the stamping press (and therefore the upper portion 104 of the die) move vertically upwards and downwards.

The upper and lower portions 104 and 112 of the die stamp a substrate (e.g., sheet metal) into a shape of the upper and lower portions 104 and 112 of the die when the upper portion 104 of the die is moved (vertically lowered) toward the lower portion 112 of the die. While the example of the upper portion 104 moving is provided, the lower portion 112 may alternatively be vertically moveable or both of the upper and lower portions 104 and 112 may be moveable.

The upper and lower portions 104 and 112 of the die, however, should not directly contact each other via the substrate. The upper and lower portions 104 and 112 of the die are initially positioned such that a predetermined gap (e.g., the same distance) exists uniformly across the surfaces between the upper and lower portions 104 and 112 of the die. Over time, however, such as due to stamping substrates, the upper and/or lower portions 104 and 112 may move. If the upper and lower portions 104 and 112 move such as to touch each other at one or more locations, flex and/or damage may occur to one or more components, such as the die and/or the stamping press. Stamping of the substrate causes the outer edges of the substrate to move inwardly (draw in) as portions of the substrate are displaced vertically upwardly and/or downwardly.

A plurality of electric motors 120 control the vertical movement. As discussed further below, operation of the electric motors 120 may be controlled by a motor control module 124 based on equalizing draw in of the substrate during stamping of a substrate at multiple (e.g., all) locations across the upper and lower portions 104 and 112.

Figure 2:
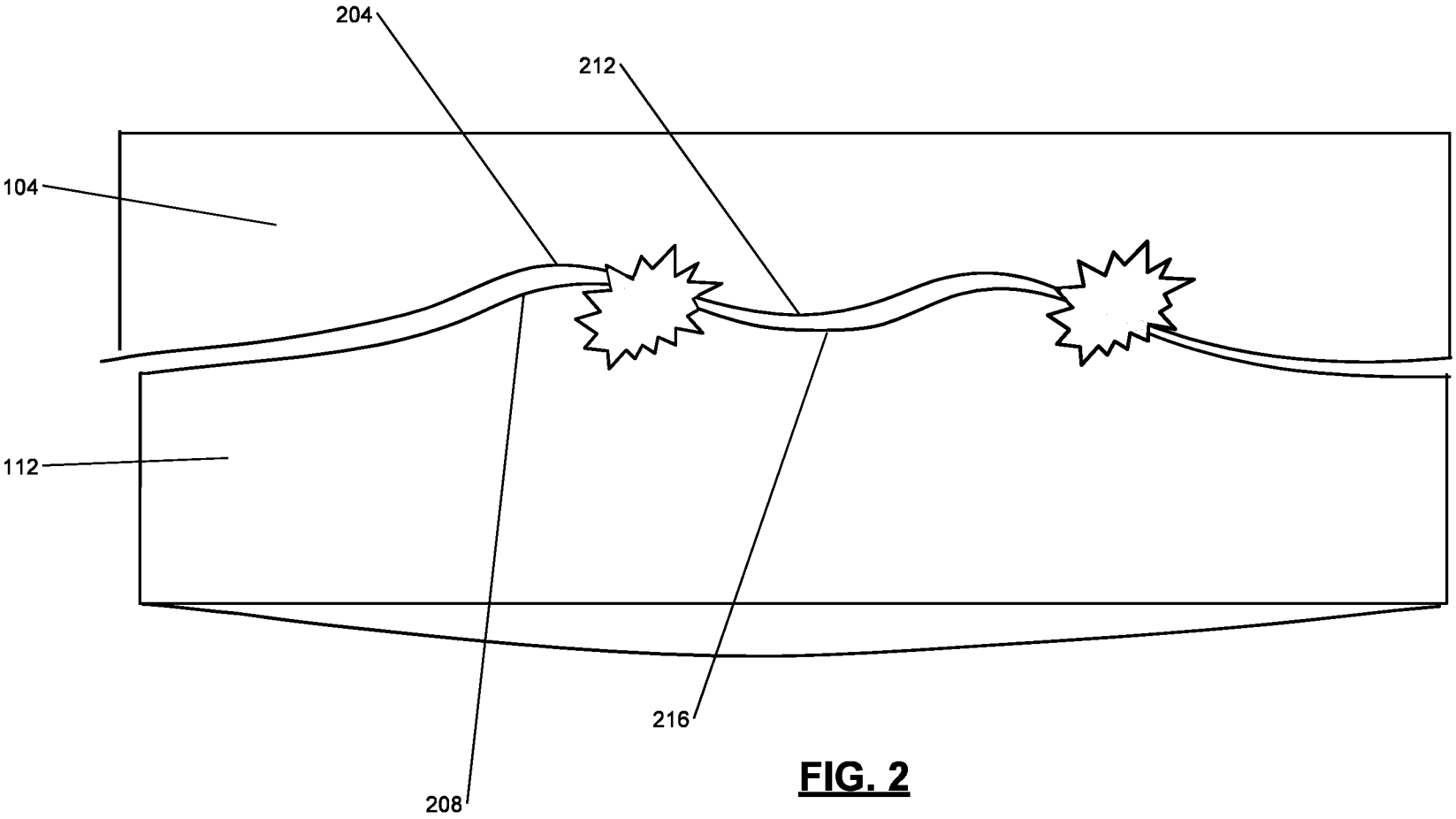
FIG. 2 illustrates a cross-sectional view of a portion of the upper and lower portions of the die of a stamping press.

FIG. 2 illustrates a cross-sectional view of a portion of the upper and lower portions 104 and 112 of the die. The upper portion 104 may include one or more concave features, such as 204. The lower portion 112 may include one or more convex features, such as 208, configured to extend into concave features, respectively, of the upper portion 104. The upper portion 104 may include one or more convex features, such as 212. The lower portion 112 may include one or more concave features, such as 216, configured to extend into convex features, respectively, of the upper portion 104. Stated generally, the upper portion 104 includes first features, and the lower portion 112 includes second features that are complementary to the first features.

If the upper and lower portions 104 and 112 are not properly aligned or move vertically faster at one location than other locations, however, one or more portions of the upper portion 104 may contact one or more portions of the lower portion 112, such as illustrated in the example of FIG. 2. Also, draw in distance and/or speed of the substrate during stamping may be different at one or more different locations.

Figure 3:
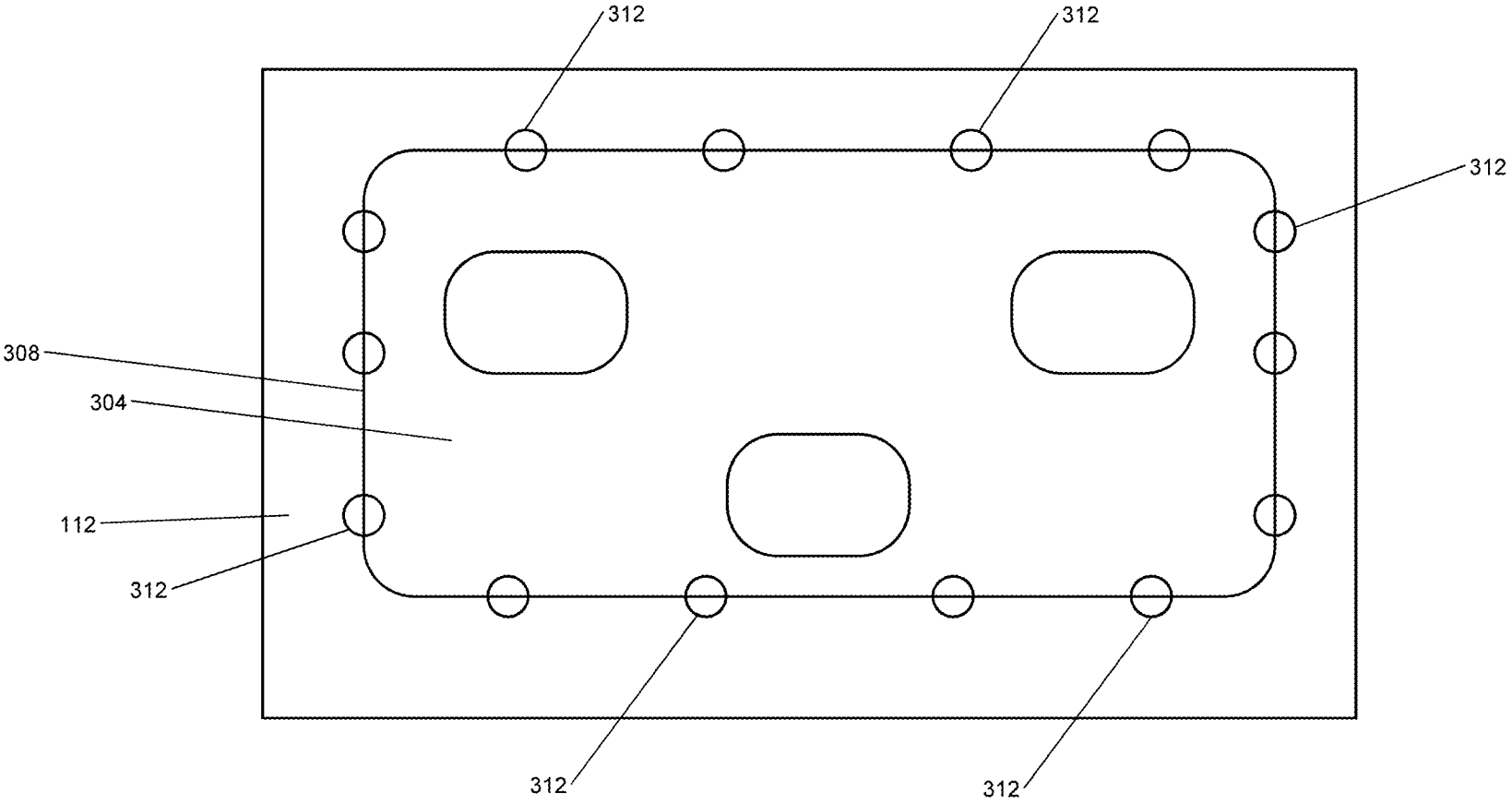
FIG. 3 includes a cross-sectional view of a portion of the upper and lower portions of the die of a stamping press.

FIG. 3 includes a top perspective view of lower portion 112 of the die. An example substrate 304 (e.g., sheet metal) to be stamped is illustrated.

The substrate 304 includes outer edges 308 that form an outer periphery of the substrate 304. Draw in sensors 312 are disposed in the lower portion 112 of the die at locations under the outer edges 308 of the substrate. While the example of four draw in sensors being disposed around the upper and lower outer edges of the substrate 304 and three draw in sensors being disposed around the right and left outer edges of the substrate 304 is provided, another other suitable number and/or arrangement of draw in sensors may be used. Additionally, while the example of a rectangular substrate is provided, the present application is also applicable to substrates having other shapes. In various implementations, one or more draw in sensors may be disposed around outer edges of one or more apertures in the substrate 304. While the example of the draw in sensors 312 being disposed in the lower portion 112 of the die is discussed herein, some or all of the draw in sensors 312 may be disposed in the upper portion 104 of the die.

Figure 4:
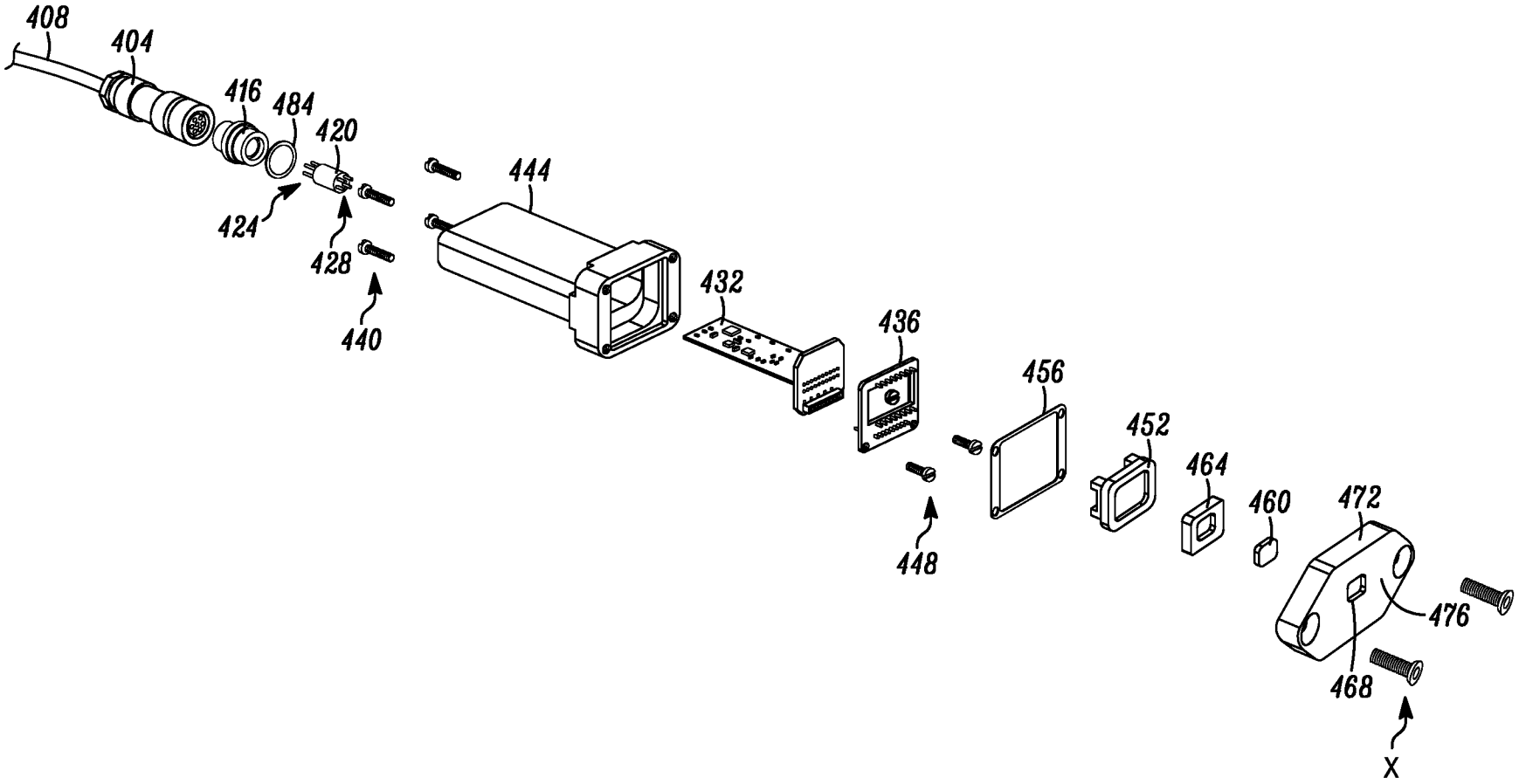
FIG. 4 is a perspective exploded view of an example implementation of a draw in sensor of a lower portion of a die.

FIG. 4 is a perspective exploded view of an example implementation of one of the draw in sensors 312 (e.g., a sensor module). Each of the draw in sensors 312 may be the same.

The draw in sensor 312 includes a female connector 404 and a wire 408 that is connected to electrically conductive pins of the female connector 404. A nut may connect the female connector 404 to a bushing 416. A male connector 420 includes first electrically conductive pins 424 that extend through the bushing and contact the pins of the female connector 404.

The male connector 420 also includes second electrically conductive pins 428 that are electrically connected with electrical conductors, respectively, of a circuit board 432, such as a printed circuit board (PCB). One or more signal processing modules and other types of modules may be implemented on the circuit board 432 and configured to determine, based signals from an optical sensor 436, a direction of movement (inward) of the outer edge of the substrate at the location of the draw in sensor, a distance of the movement of the outer edge at the location, a speed (velocity) of the movement of the outer edge at the location, and an acceleration of the edge at the location. A distance and direction module may determine the direction and distance of the movement based on the signals from the optical sensor 436. A velocity module may determine the speed of the movement based on a change in the distance over time, such as by determining a mathematical derivative of the distance or dividing two distances by a period between the measurement of the two distances. An acceleration module may determine the acceleration of the movement based on a change in the speed over time, such as by determining a mathematical derivative of the speed or dividing two speed by a period between the two determined speeds.

The circuit board 432 and the modules on the circuit board 432 may be encased in a resin or another suitable type of material in various implementations. The resin may damp vibration and serve one or more other functions. The optical sensor 436 may include an optical (e.g., laser) transmitter and an optical receiver. The optical receiver is configured to generate the signals based on light from the transmitter reflected back to the optical receiver. A driver module on the circuit board 432 may drive the optical transmitter to output light.

The circuit board 432 may be disposed within a case 444. The case 444 may be fastened to the vertically lower side of the lower portion 112 of the die via one or more fasteners 440, such as screws. One or more fasteners 448, such as screws, may fasten the circuit board 432 and the optical sensor 436 to the case 444.

The optical transmitter may transmit light through a lens 452, and the optical receiver may receive light through the lens 452. The lens 452 may be configured to not change light flow from the optical transmitter or to the optical receiver and may be transparent. A seal 456 may be disposed between the lens 452 and the optical sensor 436 and may prevent liquid and/or solid from contacting the optical sensor 436.

A film 460 may protect an outer surface of the lens 452 from being contacted, such as by liquid or solid matter. A film support 464 may be provided to support the film. The film 460 obstructs an aperture 468 through a top plate 472 of the draw in sensor 312. Light output from the optical transmitter travels through the lens 452, through the film 460, and through the aperture 468. Light returns to the optical receiver through the aperture 468, the film 460, and the lens 452.

An upper surface 476 sits flush with an upper surface of the lower portion 112 of the die. One or more fasteners 480, such as one or more screws, fasten the top plate 472 of the draw in sensor 312 to the top surface of the lower portion 112.

An O-ring 484 or another suitable type of seal may be disposed between an end of the case 444 and a shoulder of the bushing 416 such as to prevent liquid flow to the circuit board 432.

While an example form factor of the draw in sensor and fastening is provided, the present application is also applicable to other form factors and mounting to the lower portion 112. For example, the case 444 may be cylindrical and includes threads on an outer diameter of the case 444. The threads on the outer diameter of the case may engage threads on inner diameters of cylindrical bores through the lower portion 112.

Figure 5:
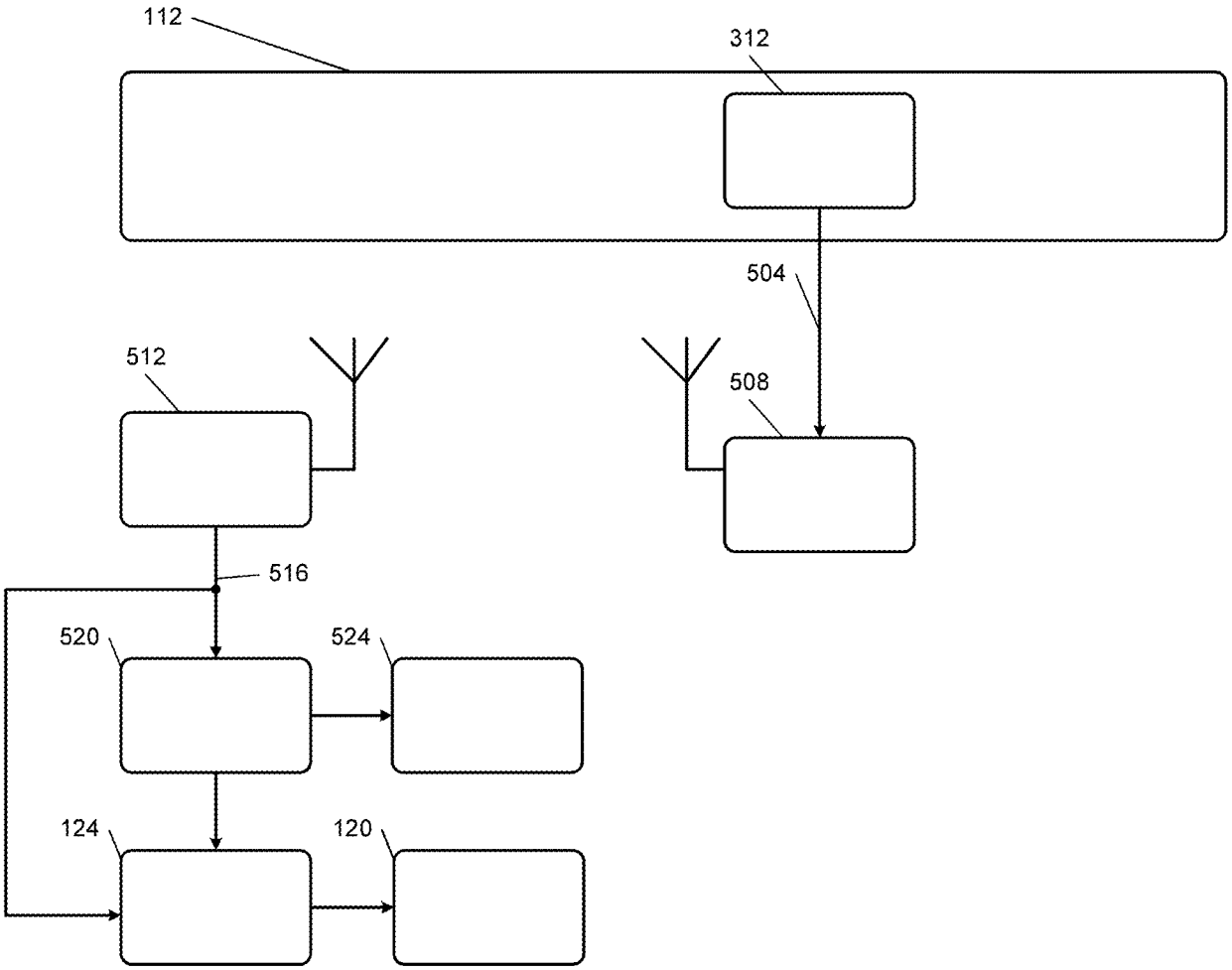
FIG. 5 includes a functional block diagram of an example die alignment system.

FIG. 5 includes a functional block diagram of an example die alignment system. The lower portion 112 (and/or the upper portion) of the die includes multiple of the draw in sensors 312.

The stamping press may include a communication module 504 that receives the draw in measurements (e.g., distance, direction, velocity, acceleration) 508 measured by the draw in sensors 312, respectively. The communication module 504 communicates the draw in measurements 508 to a draw in module 512. For example, the communication module 504 may communicate the draw in measurements 508 wirelessly via one or more antennas.

Figure 6:
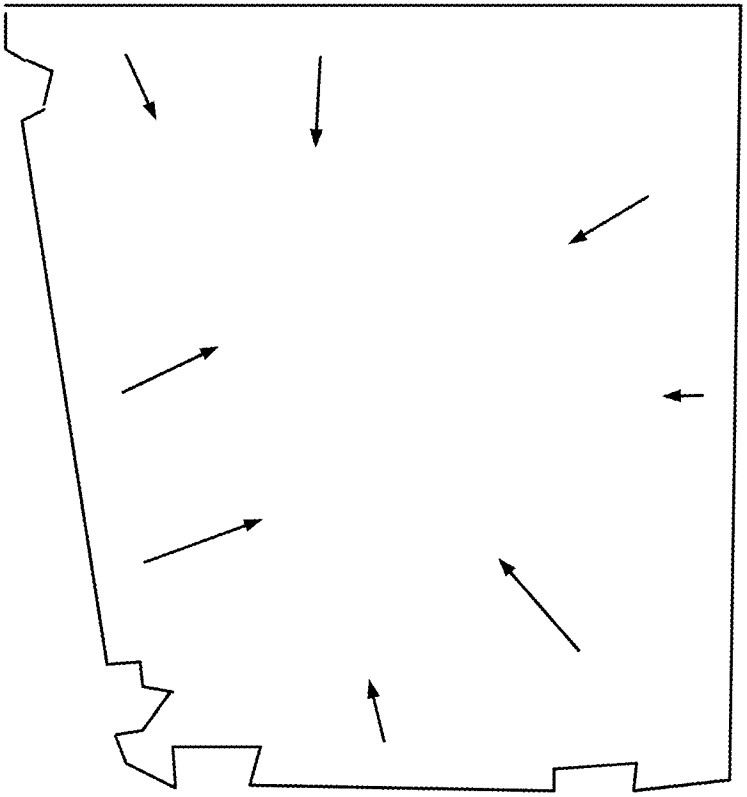
FIG. 6 includes an example draw in map.

The draw in module 512 may generate a draw in map 516 based on one or more of the draw in measurements 508 and the locations of the associated draw in sensors 312. The gap map 516 may include, for example, the draw in directions and distances 508 at coordinates of the draw in sensors 312, respectively. The draw in module 512 may, for example, interpolate draw in measurements between locations. An example map is provided in FIG. 6. In the example of FIG. 6, arrows may indicate draw in directions. Length of the arrow may correspond to draw the distance drawn in, for example increasing as distance increases and vice versa.

One or more actions may be taken based on one or more of the draw in measurements 508 and/or the map 516. For example, the motor control module 124 may compare the draw in distances and control power application to one or more of the electric motors 120 based on adjusting the distances to be within a predetermined range of each other. This may include, for example, increasing a speed of an electric motor when a draw in distance near that motor is greater than one or more other ones of the draw in distances 508 during stamping. As another example, the motor control module 124 may decrease a speed of an electric motor when a draw in distance near that motor is less than one or more other ones of the draw in distances 508 during stamping. Stated differently, the motor control module 124 may control the electric motors 120 based on achieving map that has the same draw in distances, velocities, and accelerations at each draw in sensor.

As another example of an action, a fault module 520 may identify the presence of a fault based on the draw distances and/or the map 516. For example, the fault module 520 may identify the presence of a fault when one of the distances is at least a predetermined amount greater than or less than the other distances (e.g., an average) during the stamping. As another example, the fault module 520 may indicate the presence of a fault when the map includes a value (e.g., speed) at one or more locations that is different than the value (e.g., speed) at the other locations of the map 516 by at least a predetermined amount.

The fault module 520 may indicate the presence of a fault visibly or audibly via one or more output devices 524, such as a display, a light/lamp, a speaker, or another suitable type of device that outputs sound and/or light. The fault module 520 may additionally or alternatively indicate the presence of a fault to the motor control module 124. When a fault is present, the motor control module 124 may disconnect the electric motors 120 from power (disable the electric motors 120) and stop the stamping and the vertical movement of the one or more portions of the die.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A stamping press system comprising:

a die including:

an upper portion including one or more first features;

a lower portion including one or more second features that are complementary to the first features, the lower portion also including apertures at locations, respectively, at outer edges of a substrate to be stamped; and optical sensors that are disposed within the apertures, respectively, of the lower portion and that are configured to measure directions of movement and distances of movement inward of the outer edges of the substrate at the locations, respectively, during stamping;

electric motors configured to at least one of:

vertically lower the upper portion toward the lower portion; and vertically raise the lower portion toward the upper portion; and a motor control module configured to control application of power to the electric motors.

2. The stamping press system of claim 1 wherein the motor control module is configured to control application of power to the electric motors during the at least one of the vertical lowering and the vertical raising based on at least one of the directions of movement.

3. The stamping press system of claim 2 wherein the motor control module is configured to adjust power applied to at least one of the electric motors based on adjusting at least one of the distances toward to at least one other one of the distances.

4. The stamping press system of claim 1 wherein the motor control module is configured to control application of power to the electric motors during the at least one of the vertical lowering and the vertical raising based on at least two of the distances of movement.

5. The stamping press system of claim 1 wherein the optical sensors are fastened to the lower portion via one or more fasteners.

6. The stamping press system of claim 1 further comprising a draw in module configured to generate a map based on at least one of the directions and the distances.

7. The stamping press system of claim 6 wherein the motor control module is configured to control application of power to the electric motors during the at least one of the vertical lowering and the vertical raising based on the map.

8. The stamping press system of claim 1 wherein the optical sensors each include a light transmitter and a light receiver.

9. The stamping press system of claim 1 further comprising a fault module configured to selectively indicate the presence of a fault based on at least one of the directions and the distances.

10. The stamping press system of claim 9 wherein the fault module is configured to, when the fault is present, indicate the presence of the fault via an output device that at least one of outputs sound and outputs light.

11. The stamping press system of claim 9 wherein the motor control module is configured to disconnect the electric motors from power when fault is present.

12. The stamping press system of claim 1 wherein the optical sensors are further configured to determine velocities of movement inward of the outer edges of the substrate at the locations, respectively, based on the distances of movement inward of the outer edges of the substrate at the locations, respectively.

13. The stamping press system of claim 12 wherein the optical sensors are further configured to determine accelerations of movement inward of the outer edges of the substrate at the locations, respectively, based on the velocities of movement inward of the outer edges of the substrate at the locations, respectively.

14. A die of a stamping press, the die comprising:

an upper portion including one or more first features;

a lower portion including one or more second features that are complementary to the first features, the lower portion also including apertures at locations, respectively, that extend through the lower portion; and optical sensors that are disposed within the apertures, respectively, of the lower portion and that are configured to measure directions of movement and distances of movement inward of outer edges of a substrate at the locations, respectively, during stamping of the substrate.

15. The die of claim 14 wherein the optical sensors are fastened to the lower portion of the die via one or more fasteners.

16. The die of claim 14 wherein the optical sensors each include a light transmitter and a light receiver.

17. The die of claim 14 wherein the optical sensors are further configured to determine velocities of movement inward of the outer edges of the substrate at the locations, respectively, based on the distances of movement inward of the outer edges of the substrate at the locations, respectively.

18. The die of claim 17 wherein the optical sensors are further configured to determine accelerations of movement inward of the outer edges of the substrate at the locations, respectively, based on the velocities of movement inward of the outer edges of the substrate at the locations, respectively.

19. A stamping press system comprising:

a die including:

an upper portion including one or more first features, the upper portion also including apertures at locations, respectively, at outer edges of a substrate to be stamped;

a lower portion including one or more second features that are complementary to the first features; and optical sensors that are disposed within the apertures, respectively, of the upper portion and that are configured to measure directions of movement and distances of movement inward of the outer edges of the substrate at the locations, respectively, during stamping;

electric motors configured to at least one of:

vertically lower the upper portion toward the lower portion; and vertically raise the lower portion toward the upper portion; and a motor control module configured to control application of power to the electric motors.

20. The stamping press system of claim 19 wherein the motor control module is configured to control application of power to the electric motors during the at least one of the vertical lowering and the vertical raising based on at least one of the directions of movement.

* * * * *